US010475434B2

(12) United States Patent
Yang

(10) Patent No.: US 10,475,434 B2
(45) Date of Patent: Nov. 12, 2019

(54) ELECTRONIC DEVICE AND CONTROL METHOD OF EARPHONE DEVICE

(71) Applicant: Fortemedia, Inc., Santa Clara, CA (US)

(72) Inventor: Tsung-Lung Yang, Hsinchu (TW)

(73) Assignee: FORTEMEDIA, INC., Santa Clara, CA (US)

( * ) Notice: Subject to any disclaimer, the term of this patent is extended or adjusted under 35 U.S.C. 154(b) by 26 days.

(21) Appl. No.: 15/952,439

(22) Filed: Apr. 13, 2018

(65) Prior Publication Data

US 2019/0066651 A1 Feb. 28, 2019

(30) Foreign Application Priority Data

Aug. 30, 2017 (CN) ..... 2017 1 0761504

(51) Int. Cl.

| | |
|---|---|
| ***G10K 11/16*** | (2006.01) |
| ***H04R 3/02*** | (2006.01) |
| ***H04R 1/10*** | (2006.01) |
| ***G10K 11/178*** | (2006.01) |

(52) U.S. Cl.

CPC ..... *G10K 11/17823* (2018.01); *H04R 1/1083* (2013.01); *G10K 2210/1081* (2013.01); *G10K 2210/3044* (2013.01); *G10K 2210/3046* (2013.01)

(58) Field of Classification Search

CPC ..... G10K 11/175; G10K 11/17823; G10K 11/17881; G10K 2210/1081; G10K 2210/3044; G10K 2210/3046; H04R 1/1083

USPC ..... 381/71.1, 73.1, 74

See application file for complete search history.

(56) References Cited

U.S. PATENT DOCUMENTS

| | | | | |
|---|---|---|---|---|
| 6,188,771 | B1 * | 2/2001 | Horrall | G10K 11/175 381/73.1 |
| 8,155,328 | B2 * | 4/2012 | Kotegawa | H03G 3/32 381/104 |
| 8,275,057 | B2 * | 9/2012 | Hewavithana | H04L 5/0007 370/204 |
| 9,119,009 | B1 * | 8/2015 | Folkmanis | H04R 25/55 |
| 9,837,064 | B1 * | 12/2017 | Hvidsten | G10K 11/175 |
| 2003/0144847 | A1 * | 7/2003 | Roy | H04R 27/00 704/278 |
| 2003/0198339 | A1 * | 10/2003 | Roy | H04S 1/007 379/387.01 |
| 2008/0089524 | A1 * | 4/2008 | Takeuchi | H03G 3/32 381/57 |
| 2009/0225995 | A1 * | 9/2009 | Kotegawa | H03G 3/32 381/57 |

(Continued)

*Primary Examiner* — Khai N. Nguyen

(74) *Attorney, Agent, or Firm* — McClure, Qualey & Rodack, LLP

(57) ABSTRACT

An electronic device is provided. The electronic device includes a first microphone device, a speaker, a memory circuit, and a processor. The first microphone device is configured to generate first data based on a first sound. The memory circuit at least stores acoustic data. The processor is coupled to the first microphone device and the speaker. The processor generates second data based on the first data and the acoustic data. The speaker generates a second sound based on the second data. The acoustic data includes the frequency-response of human ear and sound-masking data.

8 Claims, 10 Drawing Sheets

(56) References Cited

U.S. PATENT DOCUMENTS

| | | | | |
|---|---|---|---|---|
| 2010/0158141 | A1* | 6/2010 | Hewavithana | H04L 5/0007 375/260 |
| 2011/0002477 | A1* | 1/2011 | Zickmantel | G10K 11/175 381/73.1 |
| 2011/0075860 | A1* | 3/2011 | Nakagawa | G01H 3/00 381/94.1 |
| 2017/0352342 | A1* | 12/2017 | Lee | H04R 3/04 |
| 2018/0357995 | A1* | 12/2018 | Lee | G10K 11/175 |
| 2019/0066651 | A1* | 2/2019 | Yang | G10K 11/17823 |

* cited by examiner

ELECTRONIC DEVICE AND CONTROL METHOD OF EARPHONE DEVICE

CROSS REFERENCE TO RELATED APPLICATIONS

This Application claims priority of China Patent Application No. 201710761504.9, filed on Aug. 30, 2017, the entirety of Which is incorporated by reference herein.

BACKGROUND OF THE INVENTION

Field of the Invention

The invention relates to an electronic device, and more particularly to an electronic device equipped with a noise-reduction function.

Description of the Related Art

The noise in different environments may affect the user of an electronic device, causing the user to be unable to clearly hear the sound output by the electronic device.

If the electronic device has a noise-reduction function, the user can more clearly hear the sound that he or she wants to hear in various environments, thereby improving the application range of the electronic device. Therefore, there is a need for an electronic device to be equipped with a noise-reduction function to improve the influence of ambient noise on the audio output by the electronic device, and further improve the audio output performance of the electronic device.

BRIEF SUMMARY OF THE INVENTION

An electronic device and a method for controlling an electronic device are provided. An exemplary embodiment of an electronic device comprises a first microphone device, a speaker, a memory circuit, and a processor. The first microphone device is configured to generate first data based on a first sound. The memory circuit at least stores acoustic data. The processor is coupled to the first microphone device and the speaker. The processor generates second data based on the first data and the acoustic data. The speaker generates a second sound based on the second data. The acoustic data comprises the frequency-response of the human ear and sound-masking data.

An exemplary embodiment of a method for controlling an electronic device comprises: generating first data based on a first sound via a first microphone device of the electronic device; generating second data based on the first data and the acoustic data via a processor of the electronic device; and generating a second sound based on the second data via a speaker of the electronic device. The acoustic data comprises a human ear frequency-response and sound-masking data.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
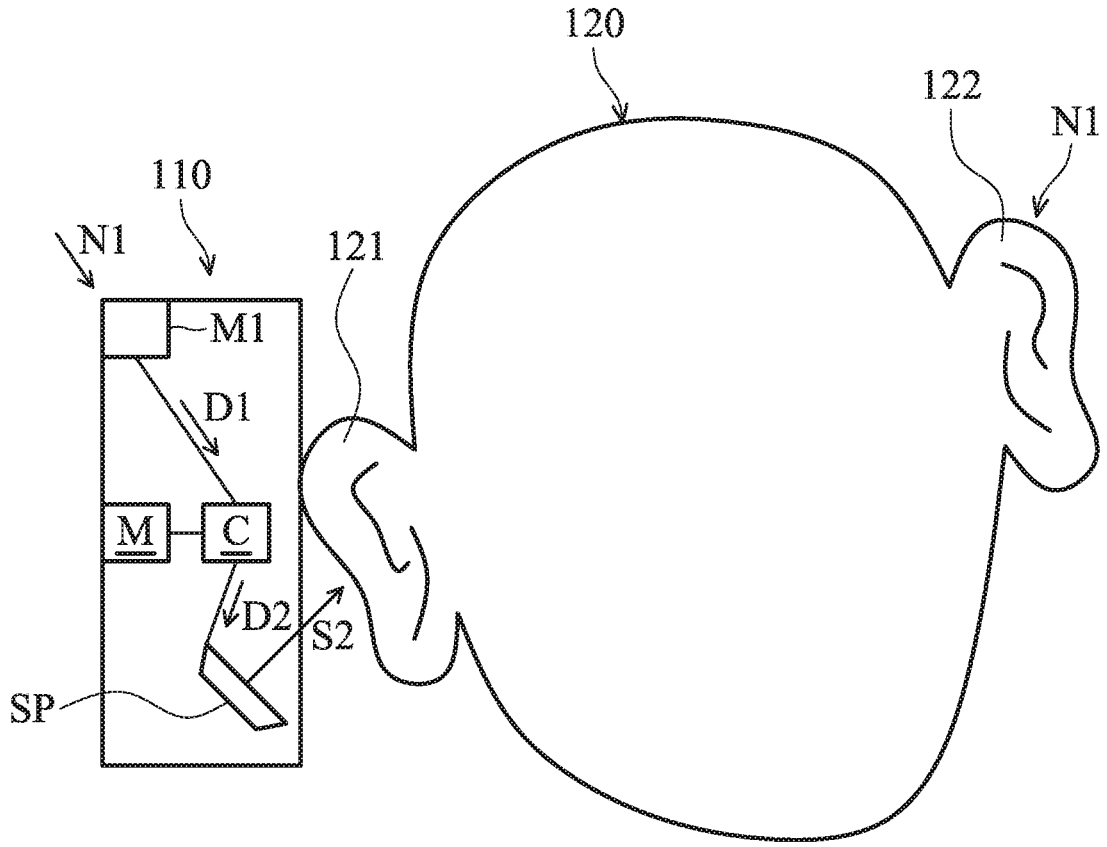
FIG. 1 is a schematic diagram of an electronic device 110 and a user 120 according to an embodiment of the invention.

FIG. 1 is a schematic diagram of an electronic device 110 and a user 120 according to an embodiment of the invention. The electronic device 110 may comprise a microphone device M1, a processor C, a memory circuit M and a speaker SP. In some embodiments, the electronic device 110 may be a mobile phone or a tablet computer. In some embodiments, the processor C may perform digital signal processing (DSP) functions. In some embodiments, the microphone device M1 may comprise analog/digital conversion circuits.

In some embodiments, the area where the user 120 is located has ambient noise, and the ambient noise is represented by the sound N1. As shown in FIG. 1, when the user 120 uses the electronic device 110, one ear 121 may be close to the electronic device 110 while the other ear 122 may be away from the electronic device 110, and the ear 122 may directly receive the sound N1.

Generally, the sound captured by a human is generated by combining the sounds received by the left ear and the right ear (for example, the ear 122 and the ear 121). For example, the sound N1 directly received by the ear 122 is mixed with the sound output by the electronic device 110 and received by the ear 121, thereby affecting the quality of the sound output by the electronic device 110 and captured by the user 120.

In some embodiments, the electronic device 110 may adjust the sound signal output by the electronic device 110 based on the sound N1 and the acoustic data stored in the memory circuit M (e.g., human ear frequency response and sound-masking data), thereby allowing the user 120 to hear the sound signal output by the electronic device 110 more clearly. In some embodiments, the acoustic data stored in the memory circuit M may comprise the frequency responses of various human ears to the sound as well as the sound-masking data of the human ear to various sounds.

Figure 2A:
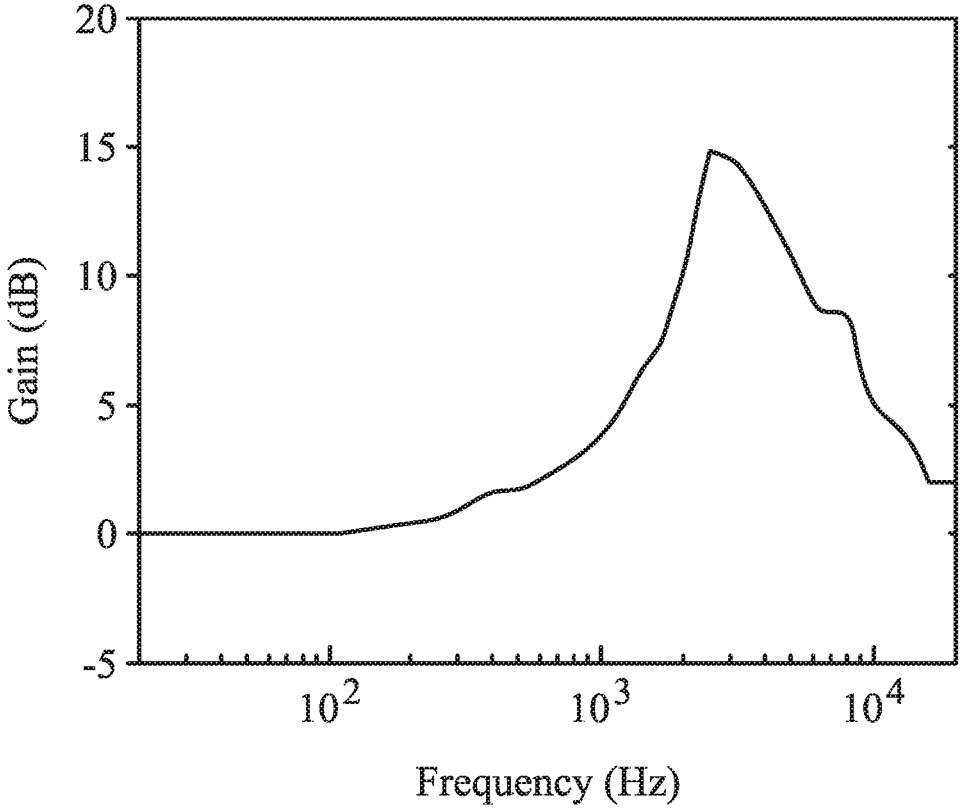
FIG. 2A is a schematic diagram of a frequency response of the human's outer ear according to an embodiment of the invention.
Figure 2B:
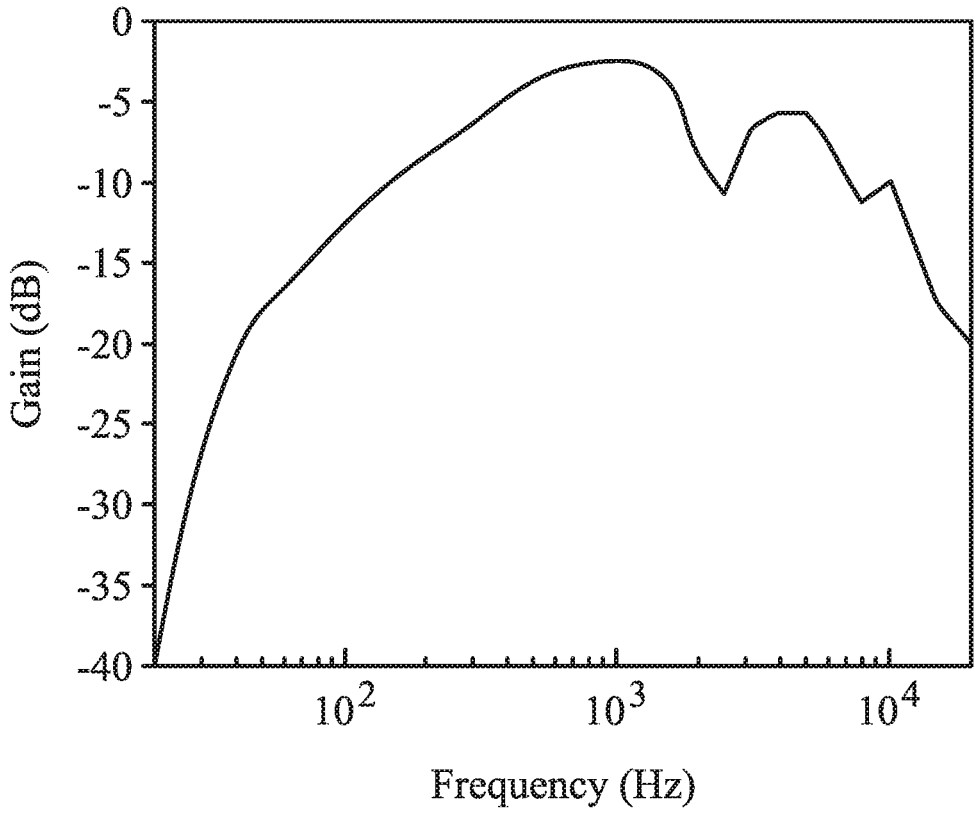
FIG. 2B is a schematic diagram of a frequency response of the human's middle ear according to an embodiment of the invention.

In some embodiments, the acoustic data stored in the memory circuit M may comprise the frequency response of the human's outer ear as shown in FIG. 2A and the frequency response of the human's middle ear as shown in FIG. 2B. As shown in FIGS. 2A and 2B, the frequency responses of the outer and middle ear will have different acoustical loudness gains at different frequencies.

In some embodiments, the acoustic data stored in the memory circuit M may comprise a variety of sound-masking data based on physiological acoustics and psychoacoustic properties. For example, the acoustic data stored in the memory circuit M may comprise the sound-masking data shown in FIG. 2C and FIG. 2D.

Figure 2C:
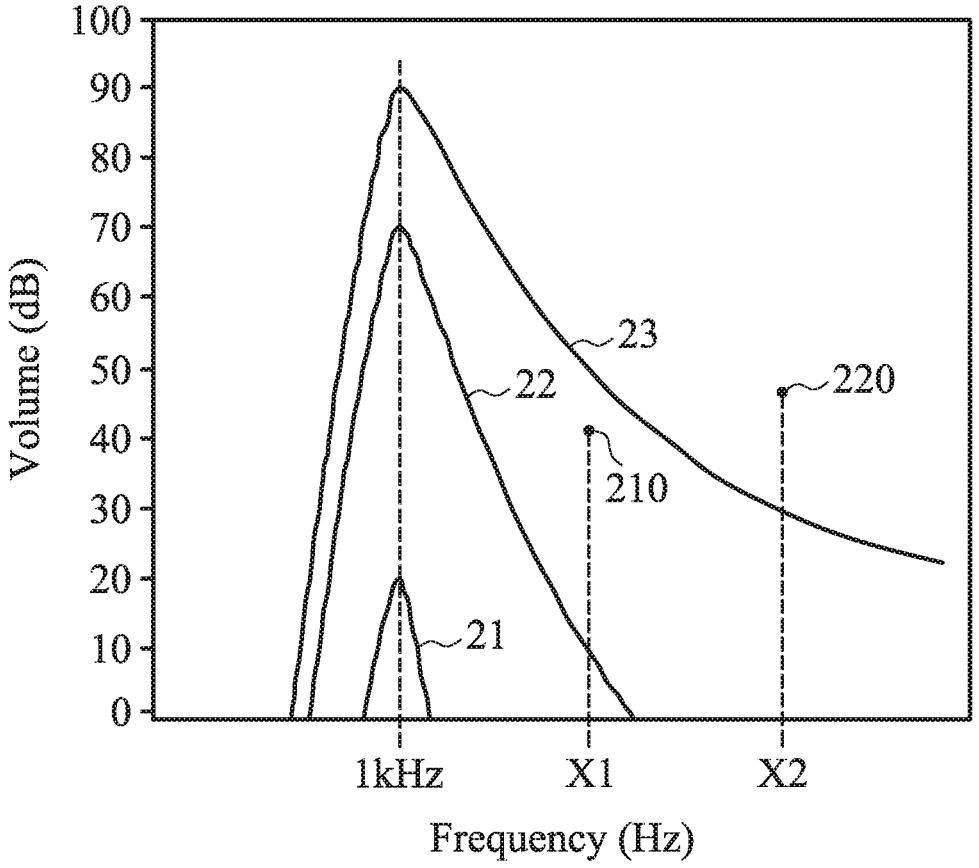
FIG. 2C is a schematic diagram showing the sound-masking effect of the 1 kHZ sound to the sounds at other frequencies.

FIG. 2C is a schematic diagram showing the sound-masking effect of the 1 kHZ sound to the sounds at other frequencies when the 1 kHZ sound is received by the user, where the curve 21 corresponds to the 1 kHz sound at 20 dB, the curve 22 corresponds to the 1 kHz sound at 70 dB, and curve 23 corresponds to the 1 kHz sound at 90 dB. For example, when the user 120 hears a first sound whose frequency is at 1 kHz and the volume is 90 dB, the sound-masking effect of the first sound to the user 120 is shown as the curve 23. In this case, the volume of the sound at each frequency must be higher than the curve 23, so as not to be masked by the first sound. For example, the sound 210 at the frequency X1 will be masked by the first sound, while the sound 220 at the frequency X2 will not masked by the first sound.

Figure 2D:
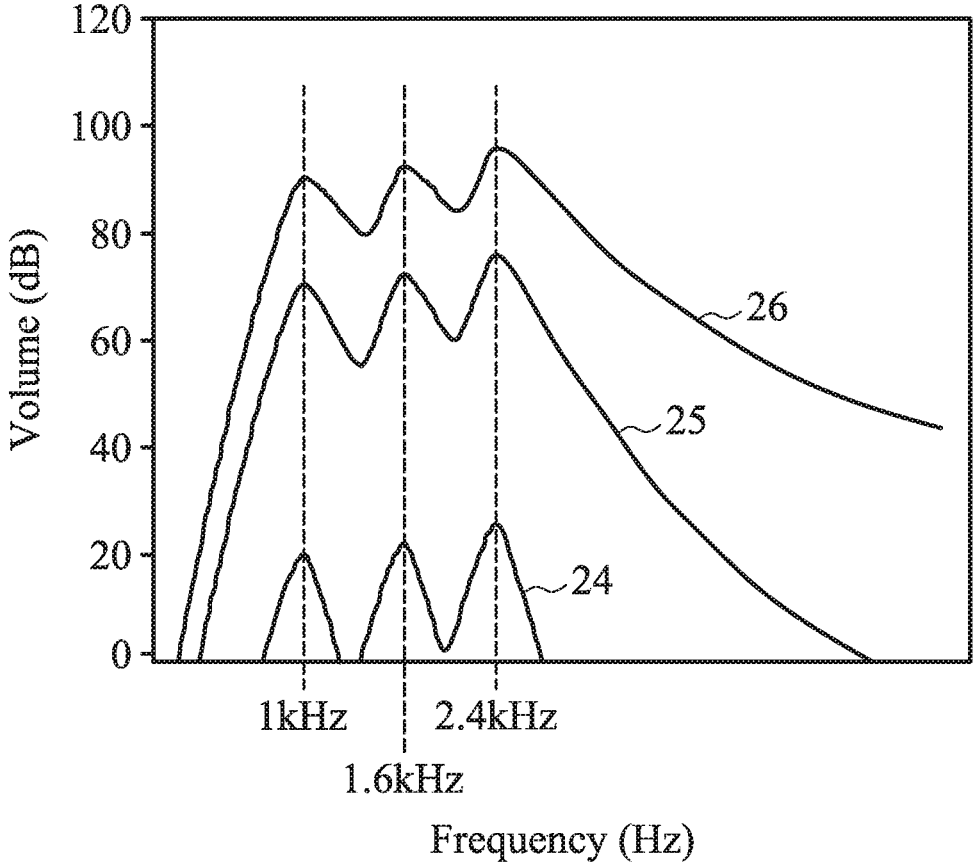
FIG. 2D is a schematic diagram showing the sound-masking effect of the 1 kHZ, 1.6 kHZ and 2.4 kHz sounds to the sounds at other frequencies.

FIG. 2D is a schematic diagram showing the sound-masking effect of the 1 kHZ, 1.6 kHZ and 2.4 kHz sounds to the sounds at other frequencies when the 1 kHZ, 1.6 kHZ and 2.4 kHz sounds are received by the user at the same time, where the curve 24 corresponds to the 1 kHZ, 1.6 kHZ and 2.4 kHz sounds at 20 dB, the curve 25 corresponds to the 1 kHZ, 1.6 kHZ and 2.4 kHz sounds at 70 dB, and the curve 26 corresponds to the 1 kHZ, 1.6 kHZ and 2.4 kHz sounds at 90 dB. Similarly, when the user 120 hears a second sound whose frequencies are at 1 kHZ, 1.6 kHZ and 2.4 kHz and their volume is 70 dB, the sound-masking effect of the second sound to the user 120 is shown as the curve 25. In this case, the volume of the sound at each frequency must be higher than the curve 25, so as not to be masked by the second sound. In some embodiments, the sound-masking data stored in the memory circuit M may further comprise the sound-masking data corresponding to the sounds at various frequencies and various volumes.

In some embodiments, the processor C of the electronic device 110 may adjust the sound to be output based on the acoustic data stored in the memory circuit M, so as to reduce the influence of the sound N1 directly received by the ear 122 of the user 120 to the sound received by the ear 121.

For example, as shown in FIGS. 1 and 2A-2D, the microphone device M1 may receive the sound N1 and generate the data D1 corresponding to the sound N1. The processor C may adjust the data D1 based on the frequency responses of the human's outer ear and middle ear as shown in FIG. 2A and FIG. 2B, thereby predicting the properties of the sound generated when the sound N1 is received by the user 120 via the ear 122. That is, the processor C may adjust the volume of the frequency components of the sound N1 corresponding to the data D1 based on the frequency responses of the human's outer ear and middle ear as shown in FIG. 2A and FIG. 2B, thereby generating the adjusted data. The sound corresponding to the adjusted data may be closer to the sound perceived by the user 120 after receiving the sound N1 through the ear 122.

Further, the processor C may select the sound-masking data (such as the sound-masking data shown in FIG. 2C and FIG. 2D) corresponding to the adjusted data based on the frequency distribution and the volume of each frequency components of the sound corresponding to the adjusted data. The processor C may adjust the volume of the sound to be output by the electronic device based on the frequency responses of the human's outer ear and middle ear as shown in FIG. 2A and FIG. 2B and the sound-masking data corresponding to the adjusted data, so as to generate the data D2. In this case, via the sound S2 generated by the speaker SP corresponding to the data D2, the sound-masking effect of the sound N1 on the user 120 in every frequency can be overcome (that is, the user 120 can feel the sound S2 is louder than the sound N1), thereby allowing the user 120 clearly hearing the sound S2 output by the electronic device 110 in the environment with the sound N1.

For example, in some embodiments, the microphone device M1 may generate the data D1 based on the 1 kHz sound N1. After receiving the data D1, the processor C may determine that the volume of the sound N1 after passing through the frequency responses of the outer ear and the middle ear as showing in FIGS. 2A and 2B is 70 dB. Next, the processor C may generate the data D2 based on the curve 22 shown in FIG. 2C and the frequency responses of the outer ear and the middle ear as showing in FIGS. 2A and 2B, and the speaker SP may generate the sound S2 based on the data D2. In this case, the user 120 may feel that the volume of the 1 kHz frequency component comprised in the sound S2 is greater than 70 dB (for example, 73 dB, 76 dB, 80 dB or others) after receiving the sound S2 via the ear 121. Therefore, the user 120 may not feel that the sound S2 is masked by the sound N1.

Based on the embodiments discussed above, even if the sound N1 is directly received by the ear 122 of the user 120, the electronic device 110 may still generate the sound S2, based on the data D1 corresponding to the sound N1 and the acoustic data stored in the memory circuit M, to overcome the masking effect caused by the sound N1 to the user 120, thereby providing better audio playing performance.

In some embodiments, if the processor C determines, based on the data D1, that a volume of the sound N1 is lower than a predetermined volume, the processor C may not generate the data D2 based on the data D1 and the acoustic data (that is, directly output the sound signal without performing adjustment), thereby improving power utilization efficiency of the electronic device 110.

In some embodiments, even if the ear 121 is close to (or contacts) the electronic device 110, there may still be a gap between the ear 121 and the electronic device 110, so that the ear 121 still receives the sound N1.

In some embodiments, the electronic device 110 provides the noise-reduction function to reduce the volume of the sound N1 received by the ear 121, thereby improving audio playing performance of the electronic device 110.

Figure 3:
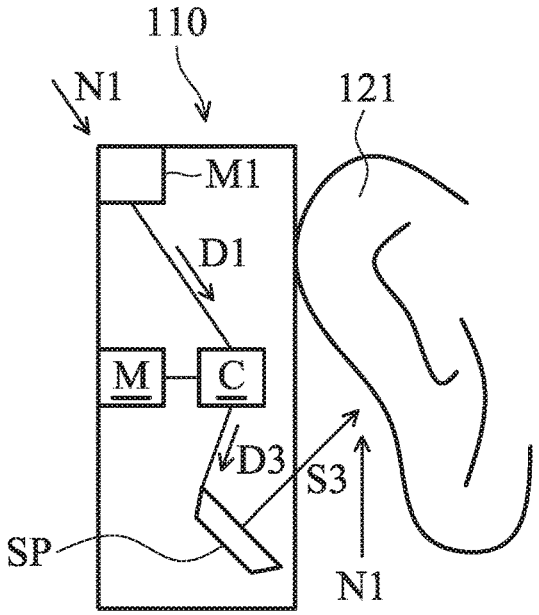
FIG. 3 is a schematic diagram of the electronic device 110 and the ear 121 according to an embodiment of the invention.

FIG. 3 is a schematic diagram of the electronic device 110 and the ear 121 according to an embodiment of the invention. In some embodiments, the memory circuit M is configured to store a plurality of parameter sets (such as lookup tables) and each parameter set comprises one or more frequency parameters, one or more volume parameters and one or more adjustment parameters. For example, one of the parameter sets may comprise the frequency parameters, the volume parameters and the adjustment parameters corresponding to a specific frequency response.

In some embodiments, the frequency parameters and the volume parameters in each parameter set may correspond to the frequency response of the ambient noise in a specific field or a specific situation. For example, the frequency response of the ambient noise in different environments such as an airplane, the MRT (mass rapid transit), the subway, the high speed rail, the train station, the office, a restaurant, or others. In addition, each parameter set may comprise one or more adjustment parameters corresponding to the specific frequency response. In some embodiments, ambient noise may refer to noise signals under 1 KHz.

As the embodiment shown in FIG. 3, after the microphone device M1 receives the sound N1, the microphone device M1 generates data D1 based on the sound N1, and transmits the data D1 to the processor C. The processor C compares the data D1 to the parameter sets in the memory circuit M. For example, the processor C may compare the frequency parameters and the volume parameters (such as the distribution of the corresponding volume of each frequency component) of the data D1 with the frequency parameters and the volume parameters in the parameter sets. In this embodiment, the processor C may determine that the frequency parameters and the volume parameters of the data D1 are most similar to the frequency parameters and the volume parameters of the n-th parameter set among the plurality of parameter sets (for example, the frequency parameter of the data D1 are most similar to that of the n-th parameter set, the volume parameter of the data D1 are most similar to that of the n-th parameter set, or the overall frequency parameter difference and the overall volume parameter difference between the data D1 and the n-th parameter set are smallest among the parameter sets). In this manner, the processor C may determine that the data D1 corresponds to the n-th parameter set among the plurality of parameter sets.

Then, the processor C may generate the data D3 based on at least the adjustment parameters of the n-th parameter set, and the speaker SP may generate the sound S3 based on the data D3. In this embodiment, a phase of the sound S3 generated by the speaker SP based on the data D3 is substantially opposite to a phase of the sound N1. In this case, when the sound N1 and the sound S3 are received by the user 120 at the same time, the user 120 will feel that volume of the sound N1 is reduced (or even eliminated), and thereby the electronic device 110 has a function of reducing noise.

For example, the memory circuit M of the electronic device 110 may store a plurality of parameter sets. Each parameter set may comprise different frequency parameters and volume parameters (for example, the frequency parameters and the volume parameters corresponding to the frequency response and the loudness of the ambient noise under a specific environment such as an airplane, the MRT, the subway, the high speed rail, the train station, the office, a restaurant, or others) and different adjustment parameters. When the user 120 is in the train station, the microphone device M1 of the electronic device 110 may generate data (for example, the data D1) after receiving the ambient noise (for example, the sound N1). The processor C may determine that the ambient noise is most similar to the parameter set corresponding to the train station noise (for example, the frequency parameters are most similar, the volume parameters are most similar, or the overall frequency parameter difference and the overall volume parameter difference are the smallest among the parameter sets). In this case, the processor C may select the parameter set corresponding to the train station noise stored in the memory circuit M based on the ambient noise, and the processor C may generate the data (for example, the data D3) based on the adjustment parameters in the parameter set corresponding to the train station noise, thereby generating a sound signal (for example, sound S3) having a phase that is opposite to that of the ambient noise (such as sound N1), and the function of noise reduction is performed.

In the above-described embodiments, the electronic device 110 may classify the ambient noise (such as sound N1) based on a plurality of pre-designed parameter sets. Therefore, after the microphone device M1 receives the ambient noise, the electronic device 110 may determine e parameter set (for example, the parameter set corresponding to the ambient noise on an airplane, the MRT, the subway, the high speed rail, the train station, the office, a restaurant, or others) which is most similar to the ambient noise, and then rapidly generate the data (for example, data D3) and the sound (for example, sound S3) based on the adjustment parameters in the parameter set corresponding to the ambient noise, so as to perform noise reduction. Therefore, via the device and the method using the plurality of parameter sets, the complexity of the circuit performing the noise-reduction function in the electronic device 110 can be reduced, and the speed at which the electronic device 110 performs noise reduction can be increased. The noise-reduction performance of the electronic device 110 can thereby be improved.

In some embodiments, the electronic device 110 may generate the data D2 and D3 at the same time and speaker may generate the sounds S2 and S3 at the same time. In some embodiments, when the processor C determines that the volume of the sound N1 is lower than a predetermined volume based on the data D1, the processor C may determine not to compare the data D1 with the parameter sets. In this case, when the volume of the ambient noise is lower than the predetermined volume (for example, when the ambient noise is very low), the processor C does not perform the noise-reduction function to generate the sound S3 as discussed above, thereby improving the power utilization efficiency of the electronic device 110.

Figure 4:
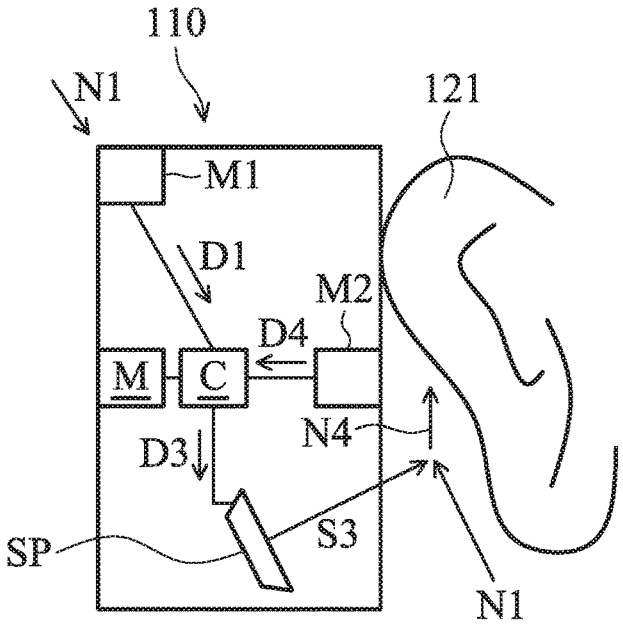
FIG. 4 is a schematic diagram of an electronic device according to another embodiment of the invention.

FIG. 4 is a schematic diagram of an electronic device according to another embodiment of the invention. Compared to the embodiments shown in FIG. 1 and FIG. 3, the electronic device 110 shown in FIG. 4 may further comprise the microphone device M2. In some embodiments, the microphone device M2 may comprise an analog/digital conversion circuits.

Referring to the embodiment of FIG. 3, the electronic device 110 may generate the sound S3 to reduce the volume of the sound N1, so as to achieve the noise-reduction function. In the embodiment shown in FIG. 4, the microphone device M2 is configured to receive the sound N4 which is a mixture of the sound N1 and the sound S3. The microphone device M2 generates the data D4 based on the sound N4, and transmits the data D4 to the processor C.

Referring to the embodiment of FIG. 3, the processor C may determine that the data D1 corresponds to the n-th parameter set in the memory circuit M. Then, the processor C generates the data D3 based on the adjustment parameters of the n-th parameter set and the data D4, and the speaker SP generates the sound N3 based on the data D3, making the electronic device 110 have the noise-reduction function.

In some embodiments, the microphone device M2 may detect the noise-reduction performance of the electronic device 110. For example, if the microphone device M2 receives the sound N4, and the processor C determines that the volume of the sound S3 is different from that of the sound N1 based on the data D4, the processor C may further adjust the data D3 based on the data D4 after the data D3 is generated based on the n-th parameter set, so as to make the volume of the sound S3 generated based on the adjusted dada D3 be closer to the volume of the sound N1 (that is, reducing the volume of the sound N4), so as to improve the noise-reduction performance of the electronic device 110.

Figure 5:
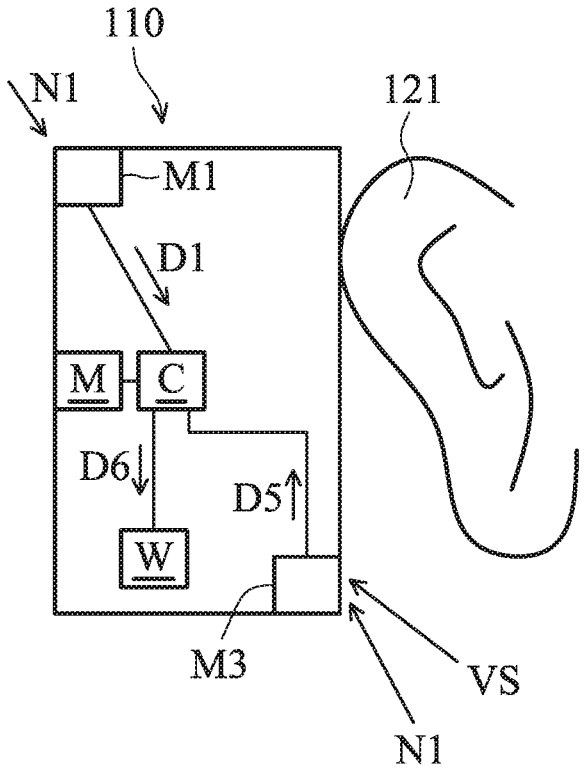
FIG. 5 is a schematic diagram of an electronic device according to another embodiment of the invention.

FIG. 5 is a schematic diagram of an electronic device according to another embodiment of the invention. Compared to the embodiments shown in FIG. 1 and FIG. 3, the electronic device 110) shown in FIG. 5 further comprises the microphone device M3 and a wireless communication module W. In this embodiment, the microphone device M3 is a talking microphone. In some embodiments, the microphone device M3 may comprise analog/digital conversion circuits.

Referring to the embodiment of FIG. 3 and FIG. 5, after receiving the voice of the user VS and the sound N1 (ambient noise), the microphone device M3 generates the data D5 based on the voice VS and the sound N1 and transmits the data D5 to the processor C. On the other hand, after the microphone device M1 receives the sound N1, the microphone device M1 generates the data D1 based on the sound N1, and transmits data D1 to the processor C. The processor C compares the data D1 with the parameter sets stored in the memory circuit M. In this embodiment, the processor C may determine that the data D1 is most similar to the n-th (n is an integer) parameter set among the parameter sets stored in the memory circuit M. Therefore, the processor C may determine that the data D1 corresponds to the n-th parameter set in the plurality of parameter sets.

Then, the processor C may adjust the data D5 based on the adjustment parameters of the n-th parameter set, so as to reduce the volume of the sound N1 in the data D5. In this case, the processor C may adjust the data D5 based on the adjustment parameters of the n-th parameter set to generate the data D6 (that is, the adjusted data D5), and transmit the data D6 to the wireless communication module W. In this embodiment, the volume of the corresponding sound N1 in the data D6 is lower than the volume of the corresponding sound N1 in the data D5, so as to achieve the noise-reduction function in the uplink signal (noise reduction for voice communication). In some embodiments, the wireless communication module W may transmit the signal comprising the data D6 for wireless communication.

Figure 6:
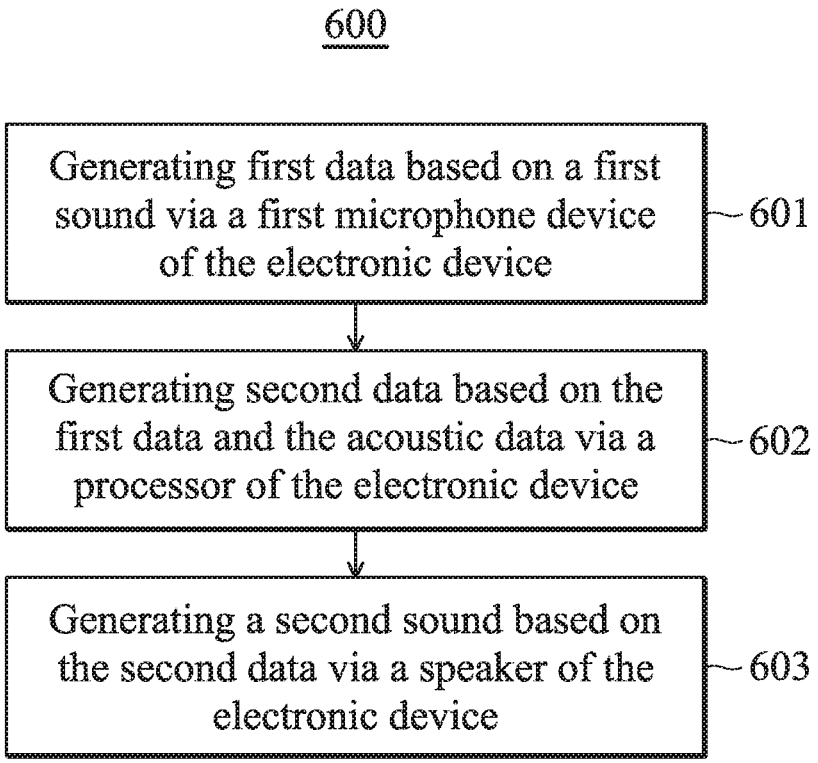
FIG. 6 is a flow chart of a method for controlling an electronic device according to an embodiment of the invention.

FIG. 6 is a flow chart of a method 600 for controlling an electronic device according to an embodiment of the invention. In step 601, the first microphone device of the electronic device generates first data based on the first sound. In step 602, the processor of the electronic device generates second data based on the first data and the acoustic data. In step 603, the speaker of the electronic device generates a second sound based on the second data. In some embodiments, the acoustic data comprises a human ear frequency-response and sound-masking data.

Figure 7:
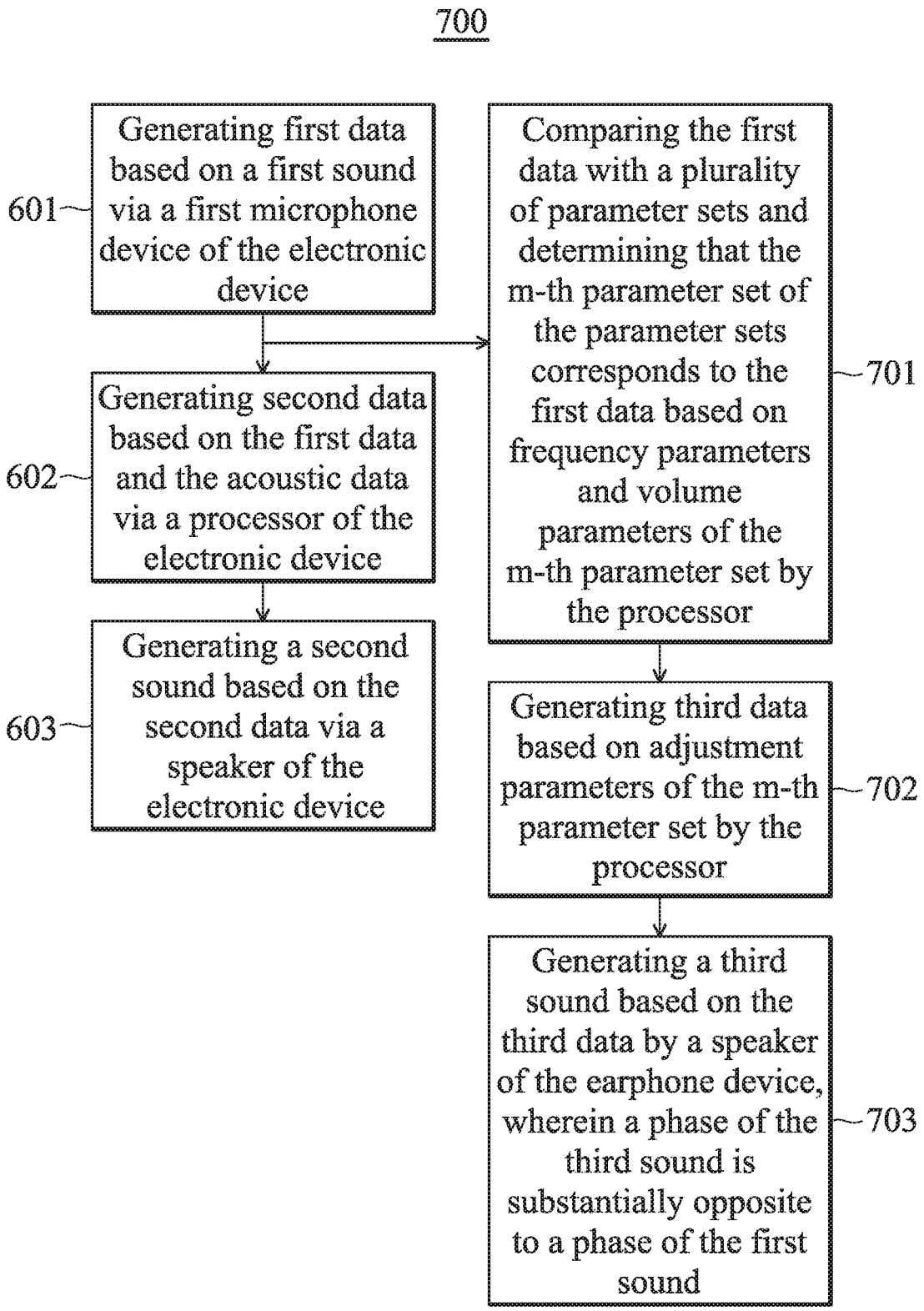
FIG. 7 is a flow chart of a method for controlling an electronic device according to an embodiment of the invention.

FIG. 7 is a flow chart of a method 700 for controlling an electronic device according to an embodiment of the invention. In step S701, the processor compares the first data with a plurality of parameter sets and determines that the m-th (m is an integer) parameter set of the parameter sets corresponds to the first data based on frequency parameters and volume parameters of the m-th parameter set. In step S702, the processor generates third data based on at least the adjustment parameters of the m-th parameter set. In step S703, the speaker of the electronic device generates a third sound based on the third data, wherein a phase of the third sound is substantially opposite to a phase of the first sound. Steps 601-603 in method 700 are the same as those in method 600, and the descriptions are omitted for brevity.

In some embodiments, the control method 700 may further comprise: receiving the fourth sound and the first sound and generating fourth data via a talking microphone device of the electronic device; transmitting the fourth data to the processor via the talking microphone device; and generating the fifth data based on the adjustment parameters of the m-th parameter set and the fourth data via the processor.

In some embodiments, the control method 700 may further comprise: not generating the second data based on the first data and the acoustic data and not comparing the first data with the parameter sets by the processor when the processor determines, based on the first data, that the volume of the first sound is lower than a predetermined volume.

Figure 8:
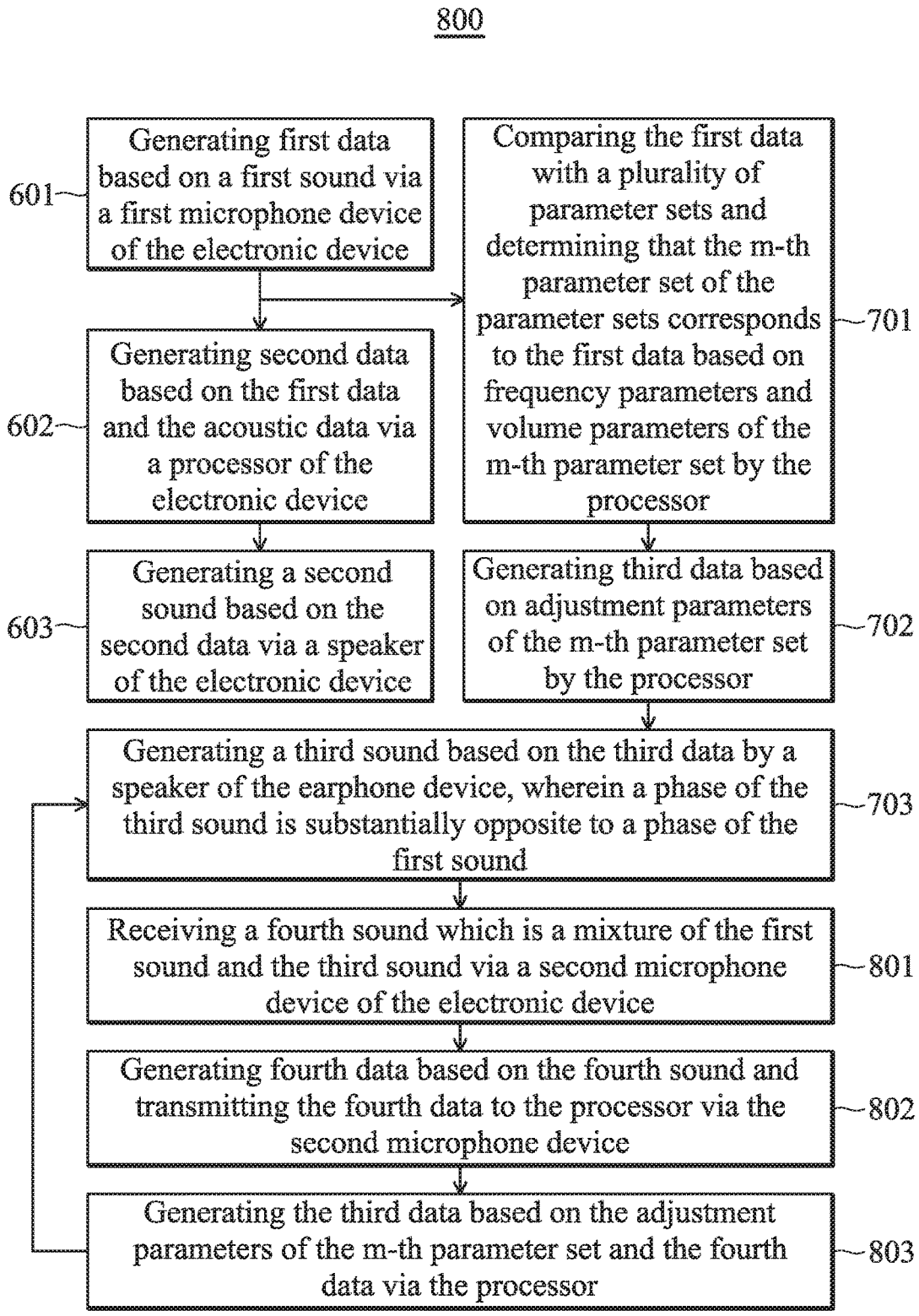
FIG. 8 is a flow chart of a method for controlling an electronic device according to an embodiment of the invention.

FIG. 8 is a flow chart of a method 800 for controlling an electronic device according to an embodiment of the invention. In step 801, the second microphone device of the electronic device receives a fourth sound which is a mixture of the first sound and the third sound. In step 802, the second microphone device generates fourth data based on the fourth sound and transmits the fourth data to the processor. In step 803, the processor generates the third data based on the adjustment parameters of the m-th parameter set and the fourth data via the processor. Steps 601-603 in method 800 are the same as those in method 600, and the descriptions are omitted for brevity.

While the invention has been described by way of example and in terms of preferred embodiment, it should be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. An electronic device, comprising:

a first microphone device, configured to generate first data based on a first sound;

a speaker;

a memory circuit, configured to at least store acoustic data, wherein the memory circuit is further configured to store a plurality of parameter sets, wherein each parameter set comprises one or more frequency parameters, one or more volume parameters, and one or more adjustment parameters; and a processor, coupled to the first microphone device and the speaker, wherein the processor is configured to generate second data based on the first data and the acoustic data, wherein the processor is configured to compare the first data with the parameter sets and determine which one of the parameter sets corresponds to the first data based on the frequency parameters and the volume parameters of the one of the parameter sets, wherein the processor is further configured to generate third data based on the adjustment parameters of the one of the parameter sets, and the speaker is configured to generate a third sound based on the third data, and wherein a phase of the third sound is substantially opposite to a phase of the first sound, wherein the speaker is configured to generate a second sound based on the second data, and wherein the acoustic data comprises a human ear frequency-response and sound-masking data.

2. The electronic device as claimed in claim 1, further comprising:

a second microphone device, coupled to the processor, wherein the second microphone device is configured to receive a fourth sound which is a mixture of the first sound and the third sound, wherein the second microphone device is further configured to generate fourth data based on the fourth sound and transmit the fourth data to the processor, and wherein the processor is further configured to generate the third data based on the adjustment parameters of the one of the parameter sets and the fourth data.

3. The electronic device as claimed in claim 1, wherein the earphone device further comprises:

a talking microphone device, coupled to the processor and configured to receive a fourth sound and the first sound and to generate fourth data, wherein the talking microphone device is configured to transmit the fourth data to the processor, and wherein the processor is configured to generate fifth data based on the adjustment parameters of the one of the parameter sets and the fourth data.

4. The electronic device as claimed in claim 1, wherein the processor is further configured to not generate the second data based on the first data and the acoustic data and not compare the first data with the parameter sets when the processor determines, based on the first data, that a volume of the first sound is lower than a predetermined volume.

5. A method for controlling an electronic device, comprising:

generating first data based on a first sound via a first microphone device of the electronic device;

configuring to at least store acoustic data;

generating second data based on the first data and the acoustic data via a processor of the electronic device; and comparing the first data with a plurality of parameter sets and determining which one of the parameter sets corresponds to the first data based on one or more frequency parameters and one or more volume parameters of the one of the parameter sets via the processor;

generating third data based one or more adjustment parameters of the one of the parameter sets via the processor;

generating a third sound based on the third data via a speaker of the electronic device, wherein a phase of the third sound is substantially opposite to a phase of the first sound;

generating a second sound based on the second data via the speaker of the electronic device, wherein the acoustic data comprises a human ear frequency-response and sound-masking data.

6. The method as claimed in claim 5, further comprising:

receiving a fourth sound which is a mixture of the first sound and the third sound via a second microphone device of the electronic device;

generating fourth data based on the fourth sound and transmitting the fourth data to the processor via the second microphone device; and generating the third data based on the adjustment parameters of the one of the parameter sets and the fourth data via the processor.

7. The method as claimed in claim 5, further comprising:

receiving a fourth sound and the first sound and generating fourth data via a talking microphone device of the electronic device;

transmitting the fourth data to the processor via the talking microphone device; and generating fifth data based on the adjustment parameters of the one of the parameter sets and the fourth data.

8. The method as claimed in claim 5, further comprising:

not generating the second data based on the first data and the acoustic data and not comparing the first data with the parameter sets by the processor when the processor determines, based on the first data, that a volume of the first sound is lower than a predetermined volume.

* * * * *